US012054307B2

(12) United States Patent
Kono et al.

(10) Patent No.: US 12,054,307 B2
(45) Date of Patent: Aug. 6, 2024

(54) SUPPORT TOOL AND CARRYING TOOL

(71) Applicant: FUJIFILM Business Innovation Corp., Tokyo (JP)

(72) Inventors: Hiroyuki Kono, Kanagawa (JP); Taisuke Endo, Kanagawa (JP); Satoshi Ishikawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 246 days.

(21) Appl. No.: 17/491,500

(22) Filed: Sep. 30, 2021

(65) Prior Publication Data

US 2022/0396395 A1 Dec. 15, 2022

(30) Foreign Application Priority Data

Jun. 11, 2021 (JP) ..... 2021-098013

(51) Int. Cl.
*B65D 19/44* (2006.01)

(52) U.S. Cl.
CPC ..... *B65D 19/44* (2013.01); *B65D 2519/0081* (2013.01)

(58) Field of Classification Search
CPC ..... B65D 19/44; B65D 2519/0081; B65D 81/02; B65D 2519/00815; B65D 2585/6897; B65D 19/38; B65D 81/05; B65D 2519/00273
USPC .... 248/499, 500, 501, 502, 506, 509, 503.1, 248/505, 510, 346.03, 346, 4
See application file for complete search history.

(56) References Cited

U.S. PATENT DOCUMENTS 1,543,253 A * 6/1925 Gerwig ..... B41J 29/04 248/680
2,496,866 A * 2/1950 Flora ..... F16B 39/14 411/522
2,651,483 A * 9/1953 Ritchie ..... B41J 29/04 248/500
2,925,861 A * 2/1960 Long ..... E06B 9/325 248/500
3,216,685 A * 11/1965 Raymond ..... H02G 3/32 248/74.2
RE28,035 E * 6/1974 Fork ..... H02G 3/283 248/500
3,913,042 A * 10/1975 Talsma ..... H01J 29/762 335/213
4,754,948 A * 7/1988 Casciani ..... A47B 95/00 248/500
D342,889 S * 1/1994 Adams ..... D8/367
(Continued)

FOREIGN PATENT DOCUMENTS

JP H08271821 10/1996
JP H1095429 4/1998

*Primary Examiner* — Kimberly T Wood
(74) *Attorney, Agent, or Firm* — JCIPRNET

(57) ABSTRACT

A support tool includes a first plate portion, a second plate portion that rises obliquely from the first plate portion and changes an angle with respect to the first plate portion by elastic deformation when receiving a load, a third plate portion that rises obliquely from a rising side edge of the second plate portion in a direction that overlaps the second plate portion when projected downward and narrows an angle with respect to the second plate portion by elastic deformation when receiving a load, and a support portion that extends from a rising side edge of the third plate portion and supports a support object.

7 Claims, 7 Drawing Sheets

(56) References Cited

U.S. PATENT DOCUMENTS

| | | | | | |
|---|---|---|---|---|---|
| 5,364,051 | A * | 11/1994 | Philpot | A47L 15/4285 | 248/62 |
| 5,392,579 | A * | 2/1995 | Champagne | E04F 13/0864 | 52/545 |
| 5,522,187 | A * | 6/1996 | Bogaerts | E04D 1/34 | 52/489.1 |
| 5,762,299 | A * | 6/1998 | Motsch | F16L 3/13 | 248/65 |
| 5,890,693 | A * | 4/1999 | Do | G06F 1/184 | 248/500 |
| D663,190 | S * | 7/2012 | Mota | D16/242 | |
| D714,626 | S * | 10/2014 | Trifari, Jr. | D8/382 | |
| 9,049,905 | B2 * | 6/2015 | Perez | A44B 17/0047 | |
| 2023/0023277 | A1 * | 1/2023 | Tsukada | B65D 81/02 | |
| 2023/0028458 | A1 * | 1/2023 | Endo | B65D 19/44 | |

* cited by examiner

SUPPORT TOOL AND CARRYING TOOL

CROSS-REFERENCE TO RELATED APPLICATIONS

This application is based on and claims priority under 35 USC 119 from Japanese Patent Application No. 2021-098013 filed Jun. 11, 2021.

BACKGROUND

(i) Technical Field

The present invention relates to a support tool and a carrying tool.

(ii) Related Art

In a case of shipping a heavy product, the product is placed on a pallet, and the product is lifted and carried together with the pallet by a forklift.

In this case, the product is carried after the work of supporting the product on the pallet by a support tool called a bracket so that the product on the pallet does not fall off the pallet during carrying, and sandwiching a cushioning material such as foamed polystyrene between the pallet and the product so that the product is not damaged by vibration.

This work before carrying, that is, a work of attaching the bracket and installing the cushioning material, is a work that requires manpower and time, and in order to improve an efficiency of the carrying work, it is required to shorten the time for this work.

Here, JP1998-095429A discloses an ingenuity in a shape for fixing the bracket to an apparatus.

SUMMARY

Aspects of non-limiting embodiments of the present disclosure relate to a support tool and a carrying tool that can take a large amount of deformation when a load in a direction of gravity is applied and is improved in a cushioning performance compared to a case where there are no three plate portions consisting of a first plate portion, a second plate portion, and a third plate portion having different angles.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a support tool including a first plate portion, a second plate portion that rises obliquely from the first plate portion and changes an angle with respect to the first plate portion by elastic deformation when receiving a load, a third plate portion that rises obliquely from a rising side edge of the second plate portion in a direction that overlaps the second plate portion when projected downward and narrows an angle with respect to the second plate portion by elastic deformation when receiving a load, and a support portion that extends from a rising side edge of the third plate portion and supports a support object.

BRIEF DESCRIPTION OF THE DRAWINGS

Exemplary embodiment(s) of the present invention will be described in detail based on the following figures, wherein.

DETAILED DESCRIPTION

Hereinafter, a comparative example will be described first, and then an exemplary embodiment of the present disclosure will be described.

Figure 1A:
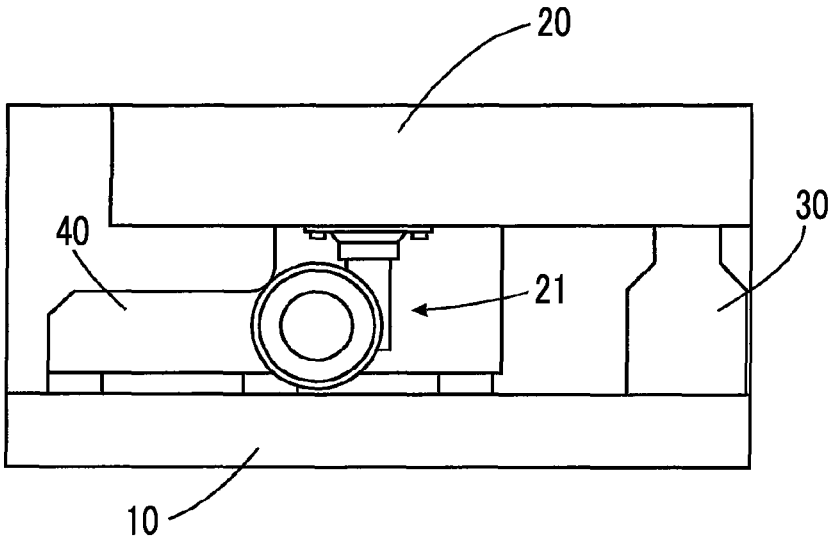
FIG. 1A RELATED ART
FIGS. 1A to 1C are diagrams showing an example as a comparative example of a method of supporting a support object on a pallet.
Figure 1B:
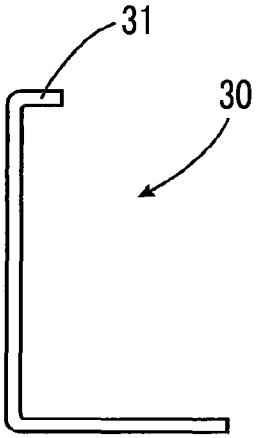
Figure 1C:
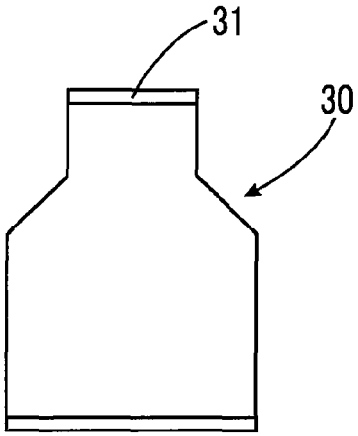

FIGS. 1A to 1C are diagrams showing an example as a comparative example of a method of supporting a support object on a pallet.

FIG. 1A shows a portion of a bottom portion of an apparatus 20 as an example of a support object placed on a pallet 10. Casters 21 are provided in a lower portion of the apparatus 20. The apparatus 20 is protected by a bracket 30 for regulating rolling or the like and a cushioning material 40 as a cushion against pitching, and is conveyed together with the pallet 10.

FIGS. 1B and 1C are a side view and a front view of the bracket 30. A hook portion 31 to be inserted into a support opening (not shown) of the apparatus 20 is provided on an upper portion of the bracket 30. In the bracket 30, the rolling or the like of the apparatus 20 is regulated by the hook portion 31 being inserted into the support opening of the apparatus 20.

In a case of this comparative example, after the apparatus 20 is placed on the pallet 10, it is necessary to support the apparatus 20 by two types of support tools, the bracket 30 and the cushioning material 40. Therefore, the work before carrying is complicated and takes time, and improvement of work efficiency is required.

Figure 2:
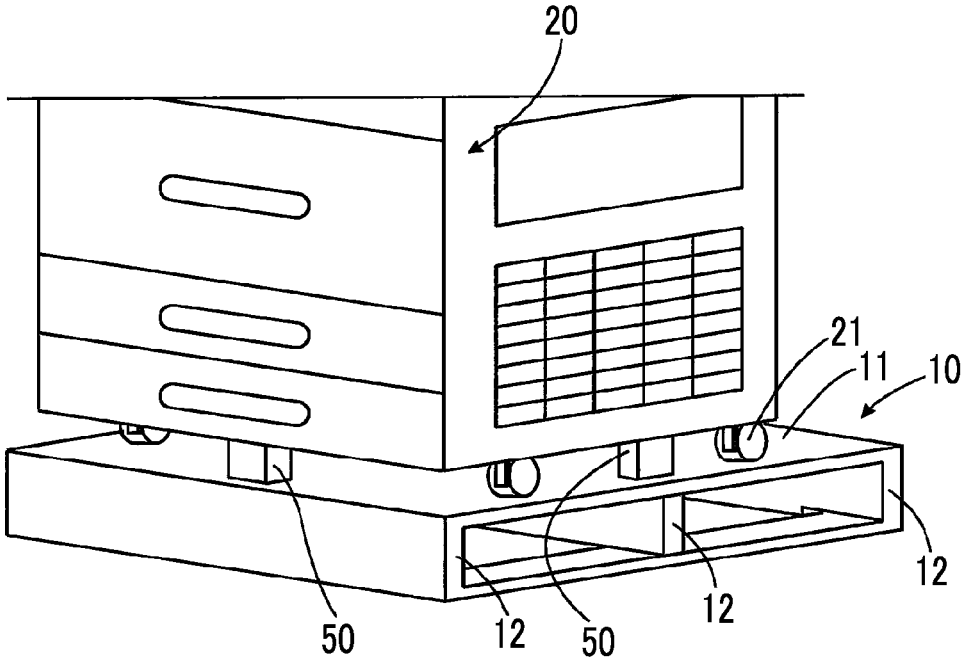
FIG. 2 is a diagram showing an example of a method of supporting an apparatus on a pallet using a support tool as an example of a present exemplary embodiment.

FIG. 2 is a diagram showing an example of a method of supporting the apparatus on the pallet using the support tool as an example of the present exemplary embodiment.

Here, as in the case of the comparative example shown in FIGS. 1A to 1C, the apparatus 20 with the caster 21 is placed on the pallet 10. The pallet 10 has a horizontal plate 11 and stringers 12 extending in contact with a lower surface of the horizontal plate 11, and has a role of placing a support object for carrying (here, the apparatus 20).

The pallet 10, the horizontal plate 11, and the stringer 12 correspond to each example of a support base, a horizontal plate portion, and a beam portion, respectively, as referred to in the present disclosure. Further, a combination of the pallet 10 and a support tool 50 placed on the stringer 12 with the horizontal plate 11 interposed therebetween corresponds to an example of a carrying tool, as referred to in the present disclosure.

The apparatus 20 is supported on the pallet 10 by a plurality of support tools 50 of the same type, which are simply shown here. The support tool 50 also serves as the bracket 30 and the cushioning material 40 shown in FIGS. 1A to 1C. The plurality of support tools 50 are placed at positions overlapping the stringers 12 with the horizontal plate 11 of the pallet 10 interposed therebetween. The support tool 50 is elastically deformed as described later, but bending of the horizontal plate 11 is smaller in a case where the support tool 50 is placed at a position where the support tool 50 overlaps the stringer 12, and compared to a case where the support tool is placed at a position away from the stringer 12, deformation as intended is realized.

Hereinafter, the support tool will be described.

Figure 3:
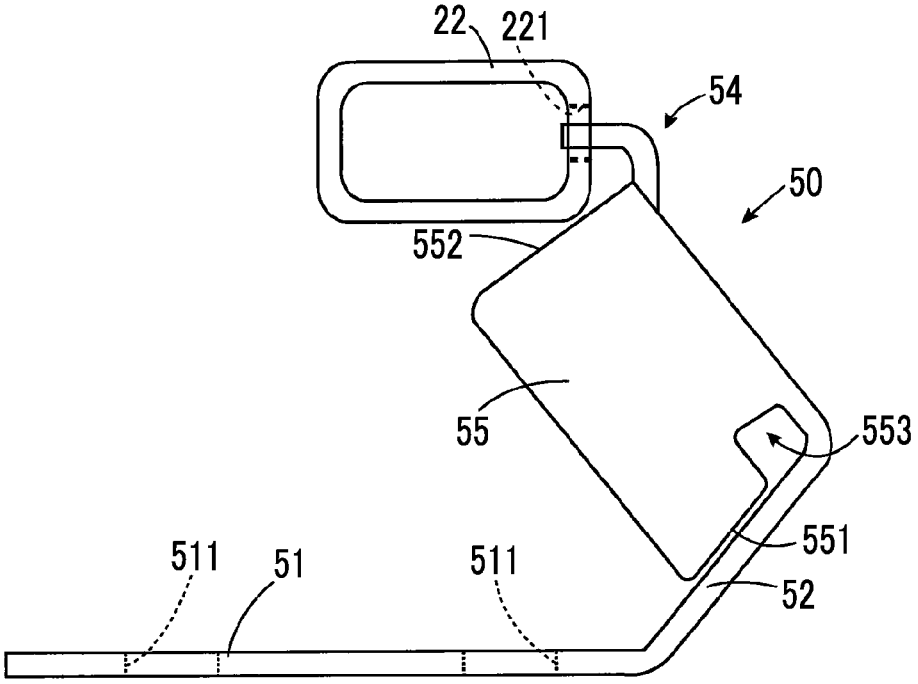
FIG. 3 is a side view of a support tool.
Figure 4:
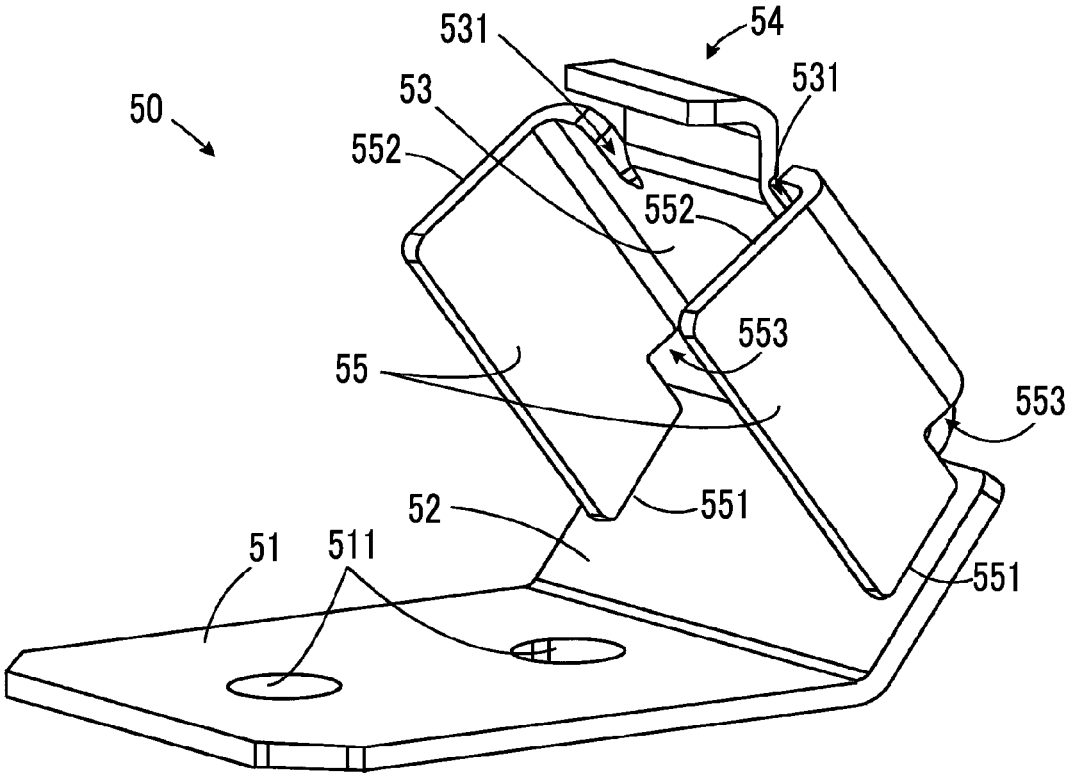
FIG. 4 is a front view of a support tool.

FIGS. 3 and 4 are a side view and a front view of the support tool.

The support tool 50 is formed by sheet metal processing of a metal plate. However, the material does not matter, and in a case of a relatively lightweight support object, the support tool 50 may be made of plastic.

The support tool 50 includes a first plate portion 51, a second plate portion 52, a third plate portion 53, and a support portion 54.

The first plate portion 51 is provided with holes 511 for fixing on the pallet 10.

Further, the second plate portion 52 rises obliquely from the first plate portion 51. In a case where the second plate portion 52 receives a load, the second plate portion 52 changes an angle with respect to the first plate portion 51 by elastic deformation.

Further, the third plate portion 53 rises obliquely from a rising side edge of the second plate portion 52 in a direction overlapping the second plate portion 52 when projected downward. In a case where the third plate portion 53 receives a load, an angle with respect to the second plate portion 52 is narrowed by elastic deformation.

Further, the support portion 54 extends from a rising side edge of the third plate portion 53, and plays a role of supporting the support object. Specifically, the support portion 54 is configured by a hook-shaped fourth plate portion that is connected to the rising side edge of the third plate portion 53 and further extends upward, and then bends and further extends. The hook-shaped support portion 54 is inserted into a support opening 221 provided in a support frame 22 that configures the lower portion of the apparatus 20 (refer to FIG. 2). The support portion 54 is inserted into the support opening 221 of the support frame 22 to suppress rolling of the apparatus 20 including the support frame 22.

Further, the third plate portion 53 is wider than the support portion 54 and has first groove portions 531 that have a shape notched downward on both sides of the support portion 54. By forming the first groove portions 531, as compared with a case where the first groove portions 531 are not provided, the elasticity of the support portion 54 against vibration in the horizontal direction is improved, and the third plate portion 53 is less likely to be damaged.

Further, the support tool 50 includes a fifth plate portion 55. The fifth plate portion 55 has a shape in which a lower end surface 551 is separated from the second plate portion 52 to extend along the second plate portion 52 from a side edge of the third plate portion 53 and an upper end surface 552 is separated from the apparatus 20 which is the support object supported by the support portion 54 to extend below the apparatus 20 from a side edge of the third plate portion 53. In the fifth plate portion 55, in a case where a load is applied and an angle between the second plate portion 52 and the third plate portion 53 is narrowed, the lower end surface 551 is abutted against the second plate portion 52.

Figure 5:
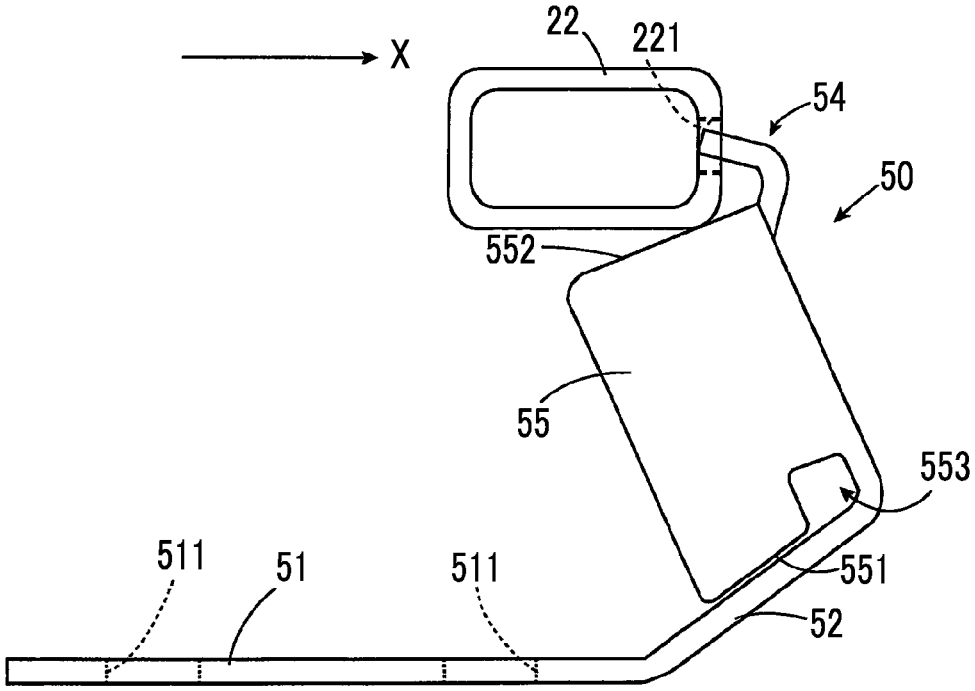
FIG. 5 is a schematic view showing a behavior of a support tool when a load in a horizontal direction is applied to an apparatus that is a support object.

FIG. 5 is a schematic view showing a behavior of a support tool when a load in a horizontal direction is applied to an apparatus that is a support object.

In a case where the support frame 22 which is a portion of the apparatus 20 receives a load in a horizontal direction indicated by an arrow X in FIG. 5 and the apparatus 20 moves, the support tool 50 is deformed so that a hook shape of the support portion 54 faces upward as shown in FIG. 5, and the hook-shaped support portion 54 is likely to come off from the support opening 221. At this time, the support frame 22 of the apparatus 20 comes into contact with the upper end surface 552 of the fifth plate portion 55, suppresses deformation in a direction in which the support portion 54 comes off from the support opening 221, and has an effect of suppressing disengagement.

By abutting the lower end surface 551 against the second plate portion 52 when a load is applied, compared with a case where the lower end surface 551 is not abutted against the second plate portion 52, an excessive narrowing of the angle between the second plate portion 52 and the third plate portion 53 may be suppressed.

Further, when a load is applied, compared with a case where the upper end surface 552 does not receive the abutting from the apparatus 20, it is possible to prevent the support portion 54 from being disengaged from the apparatus 20 which is the support object by excessive deformation.

The fifth plate portion 55 consists of a pair of fifth plate portions connected to each of the left and right side edges of the third plate portion 53 that rise obliquely. By forming the pair of the fifth plate portions 55 in this way, compared with a case where only one fifth plate portion 55 extends from one side edge of the third plate portion 53, a well-balanced deformation on the left and right is realized.

Here, the lower end surface 551 of the fifth plate portion 55 corresponds to an abutting portion referred to in the present disclosure. Further, the upper end surface 552 of the fifth plate portion 55 corresponds to an example of an abutted portion referred to in the present disclosure.

Further, in the fifth plate portion 55, a second groove portion 553 having a shape in which the lower end surface 551 is notched upward along the side edge of the third plate portion 53 is formed. By forming the second groove portion 553, compared with a case where the second groove portion 553 is not provided, a spring force of elastic deformation until the lower end surface 551 of the fifth plate portion 55 abuts against the second plate portion 52 is adjusted in a direction of weakening.

According to the support tool 50, compared to a case where there are no three plate portions consisting of the first plate portion, the second plate portion, and the third plate portion having different angles, the amount of deformation when a load in the direction of gravity is applied may be taken large, and the cushioning performance is improved.

Further, according to the support tool 50, the cost of parts and the work man-hours before carrying may be almost halved as compared with a case where the bracket 30 and the cushioning material 40 described with reference to FIGS. 1A to 1C are used.

Figure 6:
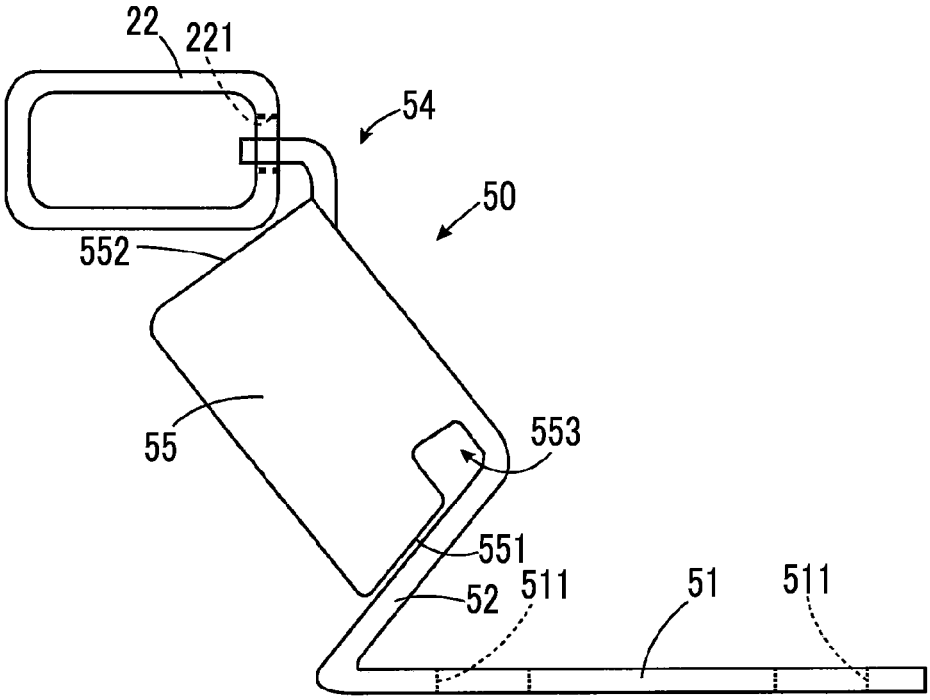
FIG. 6 is a side view showing another example of a support tool.

FIG. 6 is a side view showing another example of the support tool. The same reference numeral as the reference numeral of the support tool 50 described above will be attached, and only the difference will be described.

In the support tool 50 as another example shown in FIG. 6, the extending direction of the first plate portion 51 with respect to the portion other than the first plate portion 51 is opposite. The first plate portion 51 may extend in this direction.

Figure 7:
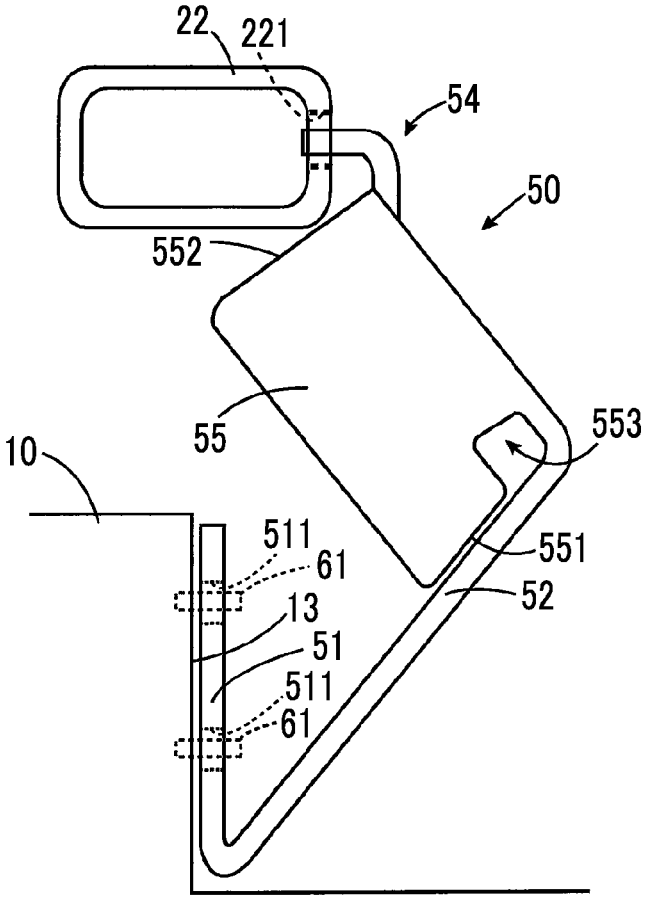
FIG. 7 is a side view showing still another example of a support tool.

FIG. 7 is a side view showing still another example of the support tool. Similar to another example of FIG. 6, the same reference numeral as the reference numeral of the support tool 50 described above will be attached, and only the difference will be described.

In the support tool 50 as still another example shown in FIG. 7, the first plate portion 51 extends vertically. Then, the first plate portion 51 is attached to a vertical wall surface 13 of the pallet 10 having a step or a recess by a fastener 61 such as a bolt and a nut. The first plate portion 51 may extend vertically in this way.

Although the structure in which the support opening 221 is provided on the side surface of the support frame 22 and the support portion 54 is inserted into the support opening 221 from the side has been described here, a structure may be adopted in which the support opening 221 is formed on the bottom surface of the support frame 22 and the support portion 54 is inserted into the support opening 221 formed on the bottom surface. In that case, the third plate portion 53 (refer to FIG. 4) abuts against the bottom surface of the support frame 22, and the support tool 50 is deformed to exert a cushioning action.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A support tool comprising:

a first plate portion;

a second plate portion that rises obliquely from the first plate portion and changes an angle with respect to the first plate portion by elastic deformation when receiving a load;

a third plate portion that rises obliquely from a rising side edge of the second plate portion in a direction that overlaps the second plate portion when projected downward and narrows an angle with respect to the second plate portion by elastic deformation when receiving a load;

a support portion that extends from a rising side edge of the third plate portion and supports a support object, and an abutting portion that is separated from the second plate portion to extend along the second plate portion from a side edge of the third plate portion, and abuts against the second plate portion when an angle between the second plate portion and the third plate portion is narrowed, wherein the third plate portion is wider than the support portion.

2. The support tool according to claim 1, wherein the support portion consists of a hook-shaped fourth plate portion that extends from the rising side edge of the third plate portion, bends, and further extends.

3. The support tool according to claim 2, wherein the third plate portion has first groove portions having a shape notched downward on both sides of the support portion.

4. The support tool according to claim 1, further comprising:

an abutted portion that is separated from the support object supported by the support portion to extend below the support object from a side edge of the third plate portion, and receives abutting of the support object when an angle between the second plate portion and the third plate portion is narrowed.

5. The support tool according to claim 2, further comprising:

an abutted portion that is separated from the support object supported by the support portion to extend below the support object from a side edge of the third plate portion, and receives abutting of the support object when an angle between the second plate portion and the third plate portion is narrowed.

6. The support tool according to claim 3, further comprising:

an abutted portion that is separated from the support object supported by the support portion to extend below the support object from a side edge of the third plate portion, and receives abutting of the support object when an angle between the second plate portion and the third plate portion is narrowed.

7. A carrying tool comprising:

a support base that has a horizontal plate portion and a beam portion extending in contact with a lower surface of the horizontal plate portion, and on which a support object for carrying is placed; and the support tool according to claim 1, that is placed at a position overlapping the beam portion with the horizontal plate portion interposed therebetween on an upper surface of the horizontal plate portion.

* * * * *